US010977933B2

(12) United States Patent
Zhao et al.

(10) Patent No.: US 10,977,933 B2
(45) Date of Patent: Apr. 13, 2021

(54) METHOD AND APPARATUS FOR PREDICTING ROAD CONDITIONS BASED ON BIG DATA

(71) Applicant: ALIBABA GROUP HOLDING LIMITED, Grand Cayman (KY)

(72) Inventors: Dan Zhao, Hangzhou (CN); Zhijia Liu, Hangzhou (CN); Kai Wu, Hangzhou (CN); Dengpo Fu, Hangzhou (CN)

(73) Assignee: ALIBABA GROUP HOLDING LIMITED, George Town (KY)

( * ) Notice: Subject to any disclaimer, the term of this patent is extended or adjusted under 35 U.S.C. 154(b) by 342 days.

(21) Appl. No.: 16/016,502

(22) Filed: Jun. 22, 2018

(65) Prior Publication Data

US 2018/0301025 A1 Oct. 18, 2018

Related U.S. Application Data

(63) Continuation of application No. PCT/CN2016/109387, filed on Dec. 12, 2016.

(30) Foreign Application Priority Data

Dec. 22, 2015 (CN) ..... 201510976430.1

(51) Int. Cl.
*G08G 1/01* (2006.01)

(52) U.S. Cl.
CPC ..... *G08G 1/0112* (2013.01); *G08G 1/0129* (2013.01)

(58) Field of Classification Search
CPC ..... G08G 1/0112; G08G 1/0129
See application file for complete search history.

(56) References Cited

U.S. PATENT DOCUMENTS

2008/0103835 A1* 5/2008 Corcoran ..... G06Q 50/08 705/4
2013/0173208 A1* 7/2013 Kuzunishi ..... G06F 19/00 702/141

FOREIGN PATENT DOCUMENTS

CN 101246645 A 8/2008
CN 101583507 A 11/2009
(Continued)

OTHER PUBLICATIONS

First Search Report and Subsequent Search Report issued in corresponding International Application No. 201510976430.1 (3 pgs.).
(Continued)

*Primary Examiner* — Catherine T. Rastovski
(74) *Attorney, Agent, or Firm* — Finnegan, Henderson, Farabow, Garrett & Dunner, LLP

(57) ABSTRACT

The present disclosure provides methods and apparatuses for predicting road conditions based on big data. One exemplary method comprises: collecting driving data associated with a road section; comparing the collected driving data with a normal observation sample to determine whether the driving data is abnormal data, putting the abnormal data and the road section into an abnormality database in response to the driving data being abnormal data, and continuously recording driving data of this road section; determining whether the road section is an abnormal road section according to the number of occurrences of abnormal data associated with the road section; and predicting a reason for the abnormality of the road section determined as the abnormal road section, according to a preset model. The technical solutions provided by the present disclosure can help accurately predict road conditions by analyzing big data, thereby saving manpower and material resources.

18 Claims, 2 Drawing Sheets

(56) References Cited

FOREIGN PATENT DOCUMENTS

| | | | |
|---|---|---|---|
| CN | 201927175 | U | 8/2011 |
| CN | 102409599 | A | 4/2012 |
| CN | 103185724 | A | 7/2013 |
| CN | 103745595 | A | 4/2014 |
| CN | 103975372 | A | 8/2014 |
| CN | 104504903 | A | 4/2015 |
| CN | 204311328 | U | 5/2015 |
| CN | 104751629 | A | 7/2015 |
| CN | 104929024 | A | 9/2015 |
| CN | 104933863 | A | 9/2015 |
| JP | 2006048501 | A | 2/2006 |
| KR | 100625096 | B1 | 9/2006 |
| WO | WO 2017/107790 | A1 | 6/2017 |

OTHER PUBLICATIONS

First Office Action issued by the State Intellectual Property Office of People's Republic of China in corresponding Chinese Application No. 201510976430.1; dated Mar. 5, 2019 (11 pgs.).

PCT International Preliminary Report on Patentability, Written Opinion and International Search Report issued in corresponding PCT International Application No. PCT/CN2016/109387; dated Mar. 12, 2017 (18 pgs.).

* cited by examiner

METHOD AND APPARATUS FOR PREDICTING ROAD CONDITIONS BASED ON BIG DATA

This application claims priority to International Application No. PCT/CN2016/109387, filed on Dec. 12, 2016, which claims priority to and the benefits of priority to Chinese Application No. 201510976430.1, filed on Dec. 22, 2015, both of which are incorporated herein by reference in their entireties.

TECHNICAL FIELD

The present disclosure generally relates to the field of data processing technologies, and in particular, to methods and apparatuses for predicting road conditions based on big data for road navigation.

BACKGROUND

With the rapid economic development, the automobile industry has entered a new development stage. Automobiles have become a household necessity. Modern times have put forward higher requirements for traffic conditions. The utilization rate of roads has increased dramatically over the past decade. Due to repeated traffic loading, rain erosion, and other factors, many road sections experience potholes, pavement cracks, and the like. These problems pose serious challenges to road maintenance.

Conventional road maintenance depends on inspection by staff or through image collection. Road maintenance personnel have to drive frequently along the roads to inspect the conditions and determine whether there are problems, which can be labor and time consuming. Additionally, some problematic road sections may be overlooked or problems may not be detected in a timely manner.

With respect to inspection of road sections based on image collection, one conventional process of pavement damage image recognition includes collection of pavement damage images, and analysis of the pavement damages images. Collection of pavement damage images can include steps of collection and acquisition, digitization, compression coding, and the like of the damage images. Analysis of the pavement damage images can include segmentation, description, and classification of the pavement damage images. Main types of segmentation include boundary-based image segmentation and region-based image segmentation.

However, given the various types of pavement damage and the difficulty to describe damage levels with a uniform analytical expression, in recent years, the study of classification and determination algorithms based on artificial intelligence has become a research hotspot. Such artificial intelligence-based research includes applying fuzzy logic, artificial neural networks, and expert systems to automatic recognition of pavement damages.

Problems with existing technologies include significant time consumption, complicated image processing, and low accuracy. More economical and efficient approaches are needed to locate damaged road sections and determine the specific types of damages, so that corresponding maintenance personnel can be dispatched to perform maintenance.

SUMMARY

The present disclosure provides methods and apparatuses for predicting road conditions based on big data. One objective of the present disclosure is to address the technical problems of low detection efficiency and low determination accuracy associated with manual inspection of road sections, and image collection and analysis.

According to some embodiments of the present disclosures, methods for predicting road conditions based on big data are provided. One exemplary method includes: collecting driving data that is recorded by vehicles running on a road section; comparing the collected driving data with a normal observation sample, to determine whether the driving data is abnormal data; putting the abnormal data and its corresponding road section into an abnormality database if the driving data is abnormal data; and continuously recording the driving data of this road section; determining whether the road section in the abnormality database is an abnormal road section according to the number of occurrences of abnormal data associated with this road section; and predicting, according to a preset model, a reason for the abnormality of the road section determined as an abnormal road section, and providing the predicted reason to a user.

According to some embodiments, the step of comparing the collected driving data with a normal observation sample, to determine whether the driving data is abnormal data can include: determining a road condition evaluation value corresponding to the road section according to the collected driving data and its corresponding weight; and comparing the determined road condition evaluation value with a road condition evaluation value range corresponding to the normal observation sample; determining that the driving data of the road section is normal data, if the road condition evaluation value corresponding to the road section is in the road condition evaluation value range corresponding to the normal observation sample; and, determining that the driving data of the road section is abnormal data.

According to some embodiments, the step of determining whether the road section is an abnormal road section according to the number of occurrences of abnormal data associated with this road section can further include: if the number of continuous occurrences of abnormal data is greater than a set threshold, determining that the road section is an abnormal road section; and, if the number of continuous occurrences of abnormal data is not greater than the set threshold, putting this road section and its driving data into an observation database; continuously tracking the driving data of the road section put into the observation database; assigning a weight to the road condition evaluation value corresponding to the driving data according to the numbers of occurrences of abnormal data and normal data in the tracked driving data; and determining whether the road section is an abnormal road section according to the product of the road condition evaluation value and its weight.

According to some embodiments, the step of assigning a weight to the road condition evaluation value corresponding to the driving data can further include: when current driving data is determined to be abnormal data, raising the weight of the road condition evaluation value corresponding to the driving data according to the cumulative number of occurrences of abnormal data; or when the current driving data is determined to be normal data, lowering the weight of the road condition evaluation value corresponding to the driving data according to the cumulative number of occurrences of normal data.

According to some embodiments, the step of determining whether the road section is an abnormal road section according to the product of the road condition evaluation value and its weight can further include: determining that the road section is a normal road section when the product of the current road condition evaluation value and its weight is less than a first set threshold; or determining that the road section is an abnormal road section when the product of the current road condition evaluation value and its weight is greater than a second set threshold.

According to some embodiments, in determining whether the road section is an abnormal road section, the method can further include: directly determining that the road section is an abnormal road section if the road condition evaluation value of the road section determined according to the collected driving data and its corresponding weight is greater than a third set threshold.

According to some embodiments of the present disclosure, apparatuses for predicting road conditions based on big data are provided. One exemplary apparatus includes a data collection module, an abnormal data determination module, an abnormal road section determination module, and an abnormality reason analysis module.

The data collection module can be configured to collect driving data that is recorded by vehicles running on a road section.

The abnormal data determination module can be configured to: compare the collected driving data with a normal observation sample, to determine whether the driving data is abnormal data; put the abnormal data and the road section into an abnormality database if the driving data is abnormal data; and continuously record the driving data of this road section.

The abnormal road section determination module can be configured to determine whether the road section in the abnormality database is an abnormal road section according to the number of occurrences of abnormal data associated with this road section.

The abnormality reason analysis module can be configured to predict, according to a preset model, a reason for the abnormality of the road section determined as an abnormal road section, and provide the predicted reason to a user.

According to some embodiments, in comparing the collected driving data with a normal observation sample, to determine whether the driving data is abnormal data, the abnormal data determination module can be further configured to perform the following operations: determining a road condition evaluation value corresponding to the road section according to the collected driving data and its corresponding weight; comparing the determined road condition evaluation value with a road condition evaluation value range corresponding to the normal observation sample; determining that the driving data of the road section is normal data, if the road condition evaluation value corresponding to the road section is in the road condition evaluation value range corresponding to the normal observation sample; and determining that the driving data of the road section is abnormal data, if the road condition evaluation value corresponding to the road section is not in the road condition evaluation value range corresponding to the normal observation sample.

In some embodiments, in determining whether the road section is an abnormal road section according to the number of occurrences of abnormal data associated with this road section, the abnormal road section determination module can be further configured to perform the following operations: if the number of continuous occurrences of abnormal data is greater than a set threshold, determining that the road section is an abnormal road section; if the number of continuous occurrences of abnormal data is not greater than the set threshold, putting this road section and its driving data into an observation database; continuously tracking the driving data of the road section put into the observation database; assigning a weight to the road condition evaluation value corresponding to the driving data according to the numbers of occurrences of abnormal data and normal data in the tracked driving data; and determining whether the road section is an abnormal road section according to the product of the road condition evaluation value and its weight.

Further, in assigning a weight to the road condition evaluation value corresponding to the driving data, the abnormal road section determination module can be further configured to: when current driving data is determined to be abnormal data, raise the weight of the road condition evaluation value corresponding to the current driving data according to the cumulative number of occurrences of abnormal data; or when the current driving data is determined to be normal data, lowering the weight of the road condition evaluation value corresponding to the current driving data according to the cumulative number of occurrences of normal data.

In some embodiments, in determining whether the road section is an abnormal road section according to the product of the road condition evaluation value and its weight, the abnormal road section determination module can be further configured to perform the following operation: determining that the road section is a normal road section, when the product of a current road condition evaluation value and its weight is less than a first set threshold; or determining that the road section is an abnormal road section, when the product of the current road condition evaluation value and its weight is greater than a second set threshold.

In some embodiments, in determining whether the road section is an abnormal road section, the abnormal road section determination module can be further configured to perform the following operation: directly determining that the road section is an abnormal road section if the road condition evaluation value of its corresponding road section determined according to the collected driving data and its corresponding weight is greater than a third set threshold.

With the methods and the apparatuses for predicting road conditions based on big data provided by the present disclosure, abnormal driving data of vehicles running on a road is collected, the driving data is compared with a normal observation sample to determine whether the driving data is abnormal data, and the abnormal data is analyzed to determine road conditions. Road conditions can be accurately predicted by analyzing big data, thereby saving manpower and material resources. Further, a damaged road section can be efficiently located and a specific damage type can be determined, thus facilitating maintenance.

DETAILED DESCRIPTION

The technical solutions of the present disclosure are further described in detail below with reference to the accompanying drawings and embodiments. The embodiments described herein are exemplary only, and they are not intended to limit the scope of the present disclosure. The following description refers to the accompanying drawings in which the same numbers in different drawings represent the same or similar elements unless otherwise represented.

The implementations set forth in the following description of exemplary embodiments do not represent all implementations consistent with the disclosure. Instead, they are merely examples of apparatuses and methods according to some embodiments of the present disclosure, the scope of which is defined by the appended claims.

Figure 1:
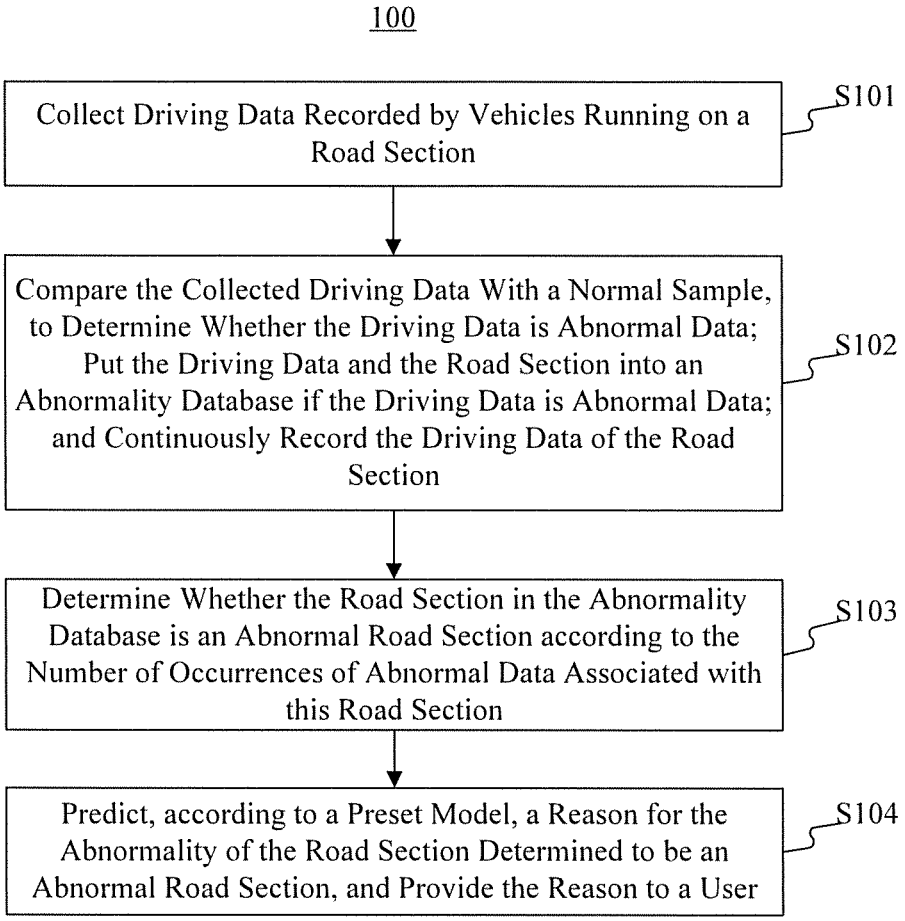
FIG. 1 is a flowchart of an exemplary method for predicting road conditions according to some embodiments of the present disclosure.

FIG. 1 is a flowchart of an exemplary method 100 for predicting road conditions according to some embodiments of the present disclosure. As shown in FIG. 1, the exemplary method 100 includes steps S101-S104.

In step S101, driving data that is recorded by vehicles running on a road section.

In some embodiments, pavement detection instruments distributed on running vehicles are used to record the driving data of the vehicles. For example, pass cards can be issued to passing vehicles at the entrance of the highway. The pass cards, serving as a pavement detection instrument, can be further used to record the driving data of the vehicles. The driving data may include corresponding driving data reflecting various conditions of the pavement, such as bumping, braking, turning, and skidding. After the pass cards are returned at the highway exit, the recorded driving data of the vehicles can be imported into a computer as basic data for subsequent analysis. Generally, the greater the amount of collected driving data, the more accurate the subsequent analysis. In some embodiments, the driving data may also be collected by using a vehicle navigation device or other devices with a data collection function, details are not described here.

It is appreciated that driving data for the same road section may be regularly collected, for example, once a week. When the driving data is normal, it may be unnecessary to continue collecting the driving data for that week. However, when the driving data is abnormal, driving data of the road section can be collected more frequently, in order to determine whether the road section is abnormal. For example, driving data can be recorded once every day or continuously recording the driving data multiple times in a day.

In step S102, the collected driving data is compared with a normal observation sample, to determine whether the driving data is abnormal data. The abnormal data and the corresponding road section can be put into an abnormality database, if the driving data is determined to be abnormal data. Driving data of this road section can be continuously recorded.

In some embodiments, the normal observation sample can be pre-stored according to driving data that is recorded by vehicles running on a normal road section. It can be used to filter the driving data used for prediction. As such, abnormal data deviating from normal data can be obtained, so that the abnormal data can be analyzed subsequently to determine the condition of a road section.

In some embodiments, a road condition evaluation value of a corresponding road section may be determined according to the collected driving data. For example, the determination could use the following calculation formula of the road condition evaluation value S:

$$s=\alpha_1 s_1+\alpha_2 s_2+\ldots+\alpha_n s_n$$

In the above formula, $s_1$ to $s_n$ are driving data of different types; and $\alpha_1$ to $\alpha_n$ are weights corresponding to the driving data of different types, wherein $\alpha_1$ to $\alpha_n$ satisfies $1=\alpha_1+\alpha_2+\ldots+\alpha_n$. Of the different types of driving data, for example, $s_1$ can be bumping data, $s_2$ can be braking data, $s_3$ can be swerving data, and the like.

In some embodiments, the driving data that is recorded by the vehicles running on the road section under normal conditions can be used as the normal observation sample. A road condition evaluation value $S_{normal}$ of this road section under a normal condition can be determined. The range of the road condition evaluation values $S_{normal}$ under normal conditions can be determined as follows, with $S_{normal_low}$ and $S_{normal_high}$ as the lower boundary and higher boundary of the range of the road condition evaluation values $S_{normal}$ respectively:

$$S_{normal}=[S_{normal_low}, S_{normal_high}]$$

After the driving data is collected, the road condition evaluation value of the road section can be determined. The determined value can then be compared with the road condition evaluation value of the normal observation sample. If the road condition evaluation value corresponding to the driving data of the road section is within the road condition evaluation range of the normal observation sample, it can be determined that the road section is a normal road section and its driving data is normal data. If the road condition evaluation value corresponding to the driving data of the road section is not within the road condition evaluation range of the normal observation sample, it can be determined that the road section is an abnormal road section and its driving data is abnormal data.

In some embodiments, driving data of a normal road section may not need to be stored, while driving data of an abnormal road section can be used as abnormal data, and can be stored for subsequent continuous analysis. The stored abnormal data can include road section identification information, driving data, and the corresponding road condition evaluation values, so that the number of occurrences of abnormal data associated with this road section can be determined in the subsequent analysis.

It is appreciated that prediction of a road section may not rely on a single occurrence of abnormal data. Occurrences of abnormalities of a road section are usually continuous or intermittent. Therefore, in some embodiments, in order to enhance accuracy, driving data over a period of time can be retained for a road section determined to be abnormal, regardless of whether the driving data is abnormal data. This can help to facilitate subsequent determination. For example, a one-week historical record for a particular road section can be retained, cyclically storing driving data every day for subsequent analysis. Expired data can be deleted.

In step S103, it can be determined whether the road section in the abnormality database is an abnormal road section according to the number of occurrences of abnormal data associated with this road section.

In some embodiments, after it is determined that driving data of a particular road section is abnormal, driving data for the road section over a period of time can be continuously recorded. For example, for the same road section, one pass card can be randomly issued every day to record driving data. Data is recorded a total of seven times in one week, to obtain the driving data of the road section for every day in one week. Alternatively, seven pass cards can be issued to different cars on the same day, with one record for each of the cars, to obtain a total of seven sets of driving data. The present disclosure does not limit a specific number of recording operations. It is appreciated that more accurate results can be obtained from more recording operations.

It is appreciated that, for a road section with abnormal data, it can be determined whether the road section is damaged or in abnormal condition by counting the number of occurrences of the abnormal data over a period of time. For example, if abnormal data is not subsequently recorded after one single occurrence, the observed abnormal data may be caused by litter on the pavement, driver operation, or misrecognition. If abnormal data is continuously recorded for a few days after one occurrence, it can be determined that an abnormality such as damage may have occurred in the road section. Staff can be sent to the site for maintenance.

In some embodiments, the step of determining whether a road section is an abnormal road section according to the number of continuous occurrences of abnormal data associated with this road section may be implemented in different manners, as described in the examples below.

In some embodiments, whether a road section is an abnormal road section can be determined based on whether the number of continuous occurrences of abnormal data is greater than a set threshold. If the number of continuous occurrences of abnormal data is greater than a set threshold, it can be determined that an abnormality occurs in this road section. If the abnormal data occurs discontinuously, the road section can be determined to be normal.

In some embodiments, whether a road section is an abnormal road section can be determined based on the proportion of the number of occurrences of abnormal data to the total number of driving data records.

After abnormal driving data occurs, the abnormal data and its corresponding road section can be put into an abnormality database, and the driving data of this road section can be continuously recorded. Assuming that the driving data is recorded M times and abnormal data occurs N times in the driving data, if N/M is greater than a set threshold, it can be determined that an abnormality occurs in this road section. If N/M is not greater than the set threshold, it can be determined that the road section is normal.

In some embodiments, a road section for which abnormal data occurs discontinuously can be put into an observation database, and the road section can be continuously monitored. For example, if the number of continuous occurrences of abnormal data for a road section is greater than a set threshold, it can be determined that an abnormality occurs in the road section and this road section is an abnormal road section. Road sections for which abnormal data occurs discontinuously can be put into the observation database. The driving data for such road sections can be continuously recorded for subsequent analysis.

It should be appreciated that after it is determined that the driving data of the road section is abnormal data, if the road condition evaluation value of the corresponding road section determined according to the collected driving data is far beyond the range of road condition evaluation value Snormal under normal conditions (such as, it exceeds a set threshold), it can be directly determined that the road section is an abnormal road section. For example, if a section of pavement suddenly fractures, the risk associated with fractures is very high, and the road condition evaluation value of the road section exceeds the set threshold. In this case, it can be regarded that the road section has problems and needs to be processed immediately. Otherwise, if a pavement fracture develops after a delay of a few days, serious dangers may be posed.

It is appreciated that if abnormal data appears only occasionally in a road section, the damage to the road section is probably not serious or the collected data is incorrect. It may be necessary to continuously monitor this road section, to further determine whether an abnormality such as damage has occurred.

In some embodiments, a road section for which abnormal data does not occur continuously can be put into an observation database for continuous observation or monitoring. For a road section that needs to be continuously observed, the method can further include the following steps: continuously tracking driving data of the road section put into the observation database; assigning a weight to a road condition evaluation value corresponding to the driving data according to the numbers of occurrences of abnormal data and normal data in the tracked driving data; and determining whether the road section is an abnormal road section according to the product of the road condition evaluation value and its weight.

For example, in the case of occasional abnormalities, abnormal data occurs in the driving data intermittently, and the pavement cannot be conclusively determined to be damaged pavement. In such cases, a weight W of the road condition evaluation value can be set. When the current driving data of the road section is determined to be abnormal data, the weight of the road condition evaluation value corresponding to the current driving data can be raised. When the current driving data of the road section is determined to be normal data, the weight of the road condition evaluation value corresponding to the current driving data can be lowered.

In some embodiments, the weight of the road condition evaluation value can be determined, for example, by using the following formula:

$$W = \begin{cases} W_{t-1} + \sigma T_{dif} \\ W_{t-1} - \sigma T_{nor} \end{cases}$$

In the formula, a is a constant, $T_{dif}$ is the cumulative number of occurrences of abnormal data from the time when the road section is added into the observation database to the current time, and $T_{nor}$ is the cumulative number of occurrences of normal data from the time when the road section is added into the observation database to the current time. The weight W of the road condition evaluation value changes, e.g., increased or decreases, in real time relative to the weight $W_{t-1}$ of the road condition evaluation value at a previous time point, as new diving data is being collected. It can be appreciated that, based on the above formula, more accumulated abnormal data results in a larger weight value, and more accumulated normal data results in a smaller weight value.

As such, determination regarding abnormality of a road section can be made according to the weight W. That is, the road section can be determined to be a normal road section, when the weight W is less than a set threshold. The road section can then be deleted from the observation database. Alternatively, it can be determined that the road section is an abnormal road section, when the weight W is greater than a set threshold.

In some embodiments, determination can be made according to the product of the road condition evaluation value and the assigned weight. That is, it can be determined that the road section is a normal road section, when the product is less than a set threshold. Alternatively, it can be determined that the road section is an abnormal road section, when the product is greater than a set threshold. If a determination cannot be made, the driving data of the road section can be continuously tracked, and determination can be made at a later time.

It should be appreciated that regardless of whether the road section is determined as an abnormal road section or a normal road section, the corresponding road section and its driving data can be deleted from the abnormality database and the observation database after the determination is made. Continuous tracking may no longer be performed, and routine determination process can be performed starting from S101.

In step S104, a reason for the abnormality of the road section determined as an abnormal road section can be predicted according to a preset model. The predicted reason can be provided to a user.

The pavement of a road section can be seen as damaged if the road section is determined as an abnormal road section. Further determination can be made as to the type of damage to the pavement and its cause, with reference to manifestation data associated with damaged pavements of different types stored in an experience database. Corresponding maintenance personnel can be sent for maintenance after the damage type is analyzed, thereby enhancing road condition detection efficiency. It is appreciated that other auxiliary techniques such as image analysis can also be used, to assist in in-depth detection and analysis of the pavement in a targeted manner.

In some embodiments, the preset model includes the manifestation data for damaged pavements of different types stored in the experience database. The experience database can be maintained in real time, storing data associated with pavement in different conditions. The experience database storing various data and updated in real time can help make pavement damage determination more reliable and accurate.

Figure 2:
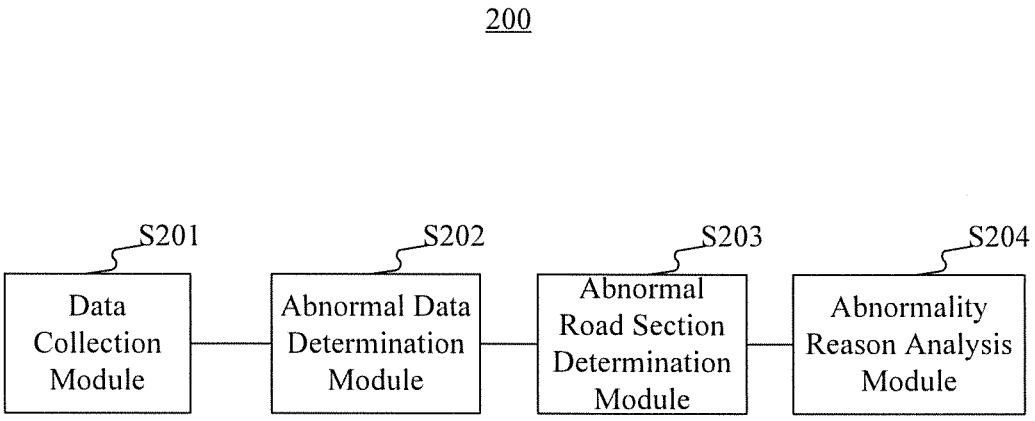
FIG. 2 is a schematic structural diagram of an exemplary apparatus for predicting road conditions according to some embodiments of the present disclosure.

FIG. 2 is a schematic structural diagram of an exemplary apparatus 200 for predicting road conditions based on big data according to some embodiments of the present disclosure. As shown in FIG. 2, this exemplary apparatus 200 includes a data collection module 201, an abnormal data determination module 202, an abnormal road section determination module 203, and an abnormality reason analysis module 204.

The data collection module 201 can be configured to collect driving data that is recorded by vehicles running on a road section.

The abnormal data determination module 202 can be configured to: compare the collected driving data with a normal observation sample, to determine whether the driving data is abnormal data; put the abnormal data and the corresponding road section into an abnormality database if the driving data is abnormal data; and continuously record driving data of this road section.

The abnormal road section determination module 203 can be configured to determine whether the road section in the abnormality database is an abnormal road section according to the number of occurrences of abnormal data associated with this road section.

The abnormality reason analysis module 204 can be configured to: predict, according to a preset model, a reason for the abnormality of the road section determined as an abnormal road section; and provide the predicted reason to a user.

In some embodiments, when comparing the collected driving data with a normal observation sample, to determine whether the driving data is abnormal data, the abnormal data determination module 202 can be configured to perform the following operations: determining a road condition evaluation value corresponding to the road section according to the collected driving data and its corresponding weight; and comparing the determined road condition evaluation value with a road condition evaluation value range corresponding to the normal observation sample; determining that the driving data of the road section is normal data, if the road condition evaluation value corresponding to the driving data of the road section is in the road condition evaluation value range corresponding to the normal observation sample; and determining that the driving data of the road section is abnormal data, if the road condition evaluation value corresponding to the driving data of the road section is not in the road condition evaluation value range corresponding to the normal observation sample.

In some embodiments, when determining whether the road section is an abnormal road section according to the number of occurrences of abnormal data associated with this road section, the abnormal road section determination module 203 can be configured to perform the following operations: if the number of continuous occurrences of abnormal data is greater than a set threshold, determining that the road section is an abnormal road section; if the number of continuous occurrences of abnormal data is not greater than the set threshold, putting this road section and its driving data into an observation database; continuously tracking driving data of the road section put into the observation database; assigning a weight to the road condition evaluation value corresponding to the driving data according to the numbers of occurrences of abnormal data and normal data in the tracked driving data; and determining whether the road section is an abnormal road section according to the product of the road condition evaluation value and its weight.

In some embodiments, in assigning a weight to the road condition evaluation value corresponding to the driving data, the abnormal road section determination module 203 can be further configured to: when current driving data is determined to be abnormal data, raise the weight of the road condition evaluation value corresponding to the current driving data according to the cumulative number of occurrences of abnormal data; and when the current driving data is determined to be normal data, lower the weight of the road condition evaluation value corresponding to the current driving data according to the cumulative number of occurrences of normal data.

In some embodiments, in determining whether the road section is an abnormal road section according to the product of the road condition evaluation value and its weight, the abnormal road section determination module 203 can be configured to perform the following operation: determining that the road section is a normal road section, when the product of the current road condition evaluation value and its weight is less than a first set threshold; and determining that the road section is an abnormal road section, when the product of the current road condition evaluation value is greater than a second set threshold.

In some embodiments, in determining whether the road section is an abnormal road section, the abnormal road section determination module 203 can be further configured to determine that the road section is an abnormal road section, if the road condition evaluation value of the corresponding road section determined according to the collected driving data and its corresponding weight is greater than a third set threshold.

It is appreciated that the embodiments of the present disclosure may be provided as a method, an apparatus, or a computer program product. For example, the processes and modules as described above reference to FIG. 1 and FIG. 2 can be implemented as a hardware embodiment, a software embodiment, or an embodiment combining software and hardware. Moreover, the embodiments of the present disclosure may be in the form of a computer program product implemented on one or more computer usable storage media (including, but not limited to, a magnetic disk memory, a CD-ROM, cloud storage, an optical memory, and the like) including computer-readable program codes therein. The storage media can include a set of instructions for instructing a computer device (which may be a personal computer, a server, a network device, a mobile device, or the like) or a processor to perform a part of the steps of the methods described in the embodiments of the present disclosure. The foregoing storage medium may include, for example, any medium that can store a program code, such as a USB flash disk, a removable hard disk, a Read-Only Memory (ROM), a Random Access Memory (RAM), a magnetic disk, or an optical disc. The storage medium can be a non-transitory computer readable medium. Common forms of non-transitory media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM or any other flash memory, NVRAM any other memory chip or cartridge, and networked versions of the same.

The foregoing describes the technical solutions according to some embodiments of the present disclosure. The description herein is exemplary, and it is not intended to limit the scope of the present disclosure. Persons skilled in the art can make various modifications and changes consistent with the present disclosure, without departing from the spirit and essence of the present disclosure. These changes and modifications all shall fall within the protection scope of the present disclosure.

The invention claimed is:

1. A method for predicting road conditions, comprising:

collecting driving data reflecting pavement conditions associated with a road section, the driving data recorded by one or more pavement detection instruments distributed on vehicles running on the road section;

comparing the collected driving data with a normal sample, to determine whether the driving data is abnormal data;

determining whether the road section is an abnormal road section by comparing a number of occurrences of abnormal data associated with the road section with a preset threshold; predicting a reason for abnormality of the road section by applying a preset model to the collected driving data, in response to the road section being an abnormal road section, the reason for abnormality being associated with a type and a cause of a damage to the pavement conditions of the road section; and providing the reason for abnormality of the road to a user to perform maintenance to the road section based on the predicted type and cause of the damage to the pavement conditions of the road section.

2. The method for predicting road conditions according to claim 1, wherein comparing the collected driving data with a normal sample, to determine whether the driving data is abnormal data comprises:

determining a road condition evaluation value corresponding to the road section, based on the collected driving data;

comparing the determined road condition evaluation value with a road condition evaluation value range corresponding to the normal sample;

determining that the driving data is normal data in response to the determined road condition evaluation value being in the road condition evaluation value range corresponding to the normal sample; or determining that the driving data of the road section is abnormal data in response to the determined road condition evaluation value not being in the road condition evaluation value range corresponding to the normal sample.

3. The method for predicting road conditions according to claim 2, wherein determining whether the road section is an abnormal road section according to the number of occurrences of abnormal data associated with the road section comprises:

in response to the number of continuous occurrences of abnormal data being greater than the present threshold, determining that the road section is an abnormal road section; or in response to the number of continuous occurrences of abnormal data being not greater than the preset threshold:

collecting additional driving data associated with the road section;

assigning a weight to the determined road condition evaluation value corresponding to the additional driving data according to the numbers of occurrences of abnormal data and normal data; and determining whether the road section is an abnormal road section according to the product of the determined road condition evaluation value and the assigned weight.

4. The method for predicting road conditions according to claim 3, wherein assigning a weight to the determined road condition evaluation value corresponding to the additional driving data comprises:

in response to current driving data being abnormal data, raising the weight according to a cumulative number of occurrences of abnormal data; or in response to the current driving data being normal data, lowering the weight according to a cumulative number of occurrences of normal data.

5. The method for predicting road conditions according to claim 4, wherein determining whether the road section is an abnormal road section according to the product of the determined road condition evaluation value and the assigned weight comprises:

determining that the road section is a normal road section in response to the product of the determined road condition evaluation value and the assigned weight being less than a first set threshold; or determining that the road section is an abnormal road section in response to the product of the determined road condition evaluation value and the assigned weight being greater than a second set threshold.

6. The method for predicting road conditions according to claim 2, further comprising:

determining that the road section is an abnormal road section in response to the determined road condition evaluation value being greater than a third set threshold.

7. An apparatus for predicting road conditions, comprising:

a memory storing a set of instructions; and a processor configured to execute the set of instructions to cause the apparatus to perform:

collecting driving data reflecting pavement conditions associated with a road section, the driving data recorded by one or more pavement detection instruments distributed on vehicles running on the road section;

comparing the collected driving data with a normal sample, to determine whether the driving data is abnormal data;

determining whether the road section is an abnormal road section according to the by comparing a number of occurrences of abnormal data associated with the road section with a preset threshold;

predicting a reason for abnormality of the road section by applying a preset model to the collected driving data, in response to the road section being an abnormal road section, the reason for abnormality being associated with a type and a cause of a damage to the pavement conditions of the road section; and providing the reason for abnormality of the road to a user to perform maintenance to the road section based on the predicted type and cause of the damage to the pavement conditions of the road section.

8. The apparatus for predicting road conditions according to claim 7, wherein comparing the collected driving data with the normal sample, to determine whether the driving data is abnormal data further comprises:

determining a road condition evaluation value corresponding to the road section, based on the collected driving data;

comparing the determined road condition evaluation value with a road condition evaluation value range corresponding to the normal sample;

determining that the driving data is normal data, in response to the determined road condition evaluation value being in the road condition evaluation value range corresponding to the normal sample; or determining that the driving data of the road section is abnormal data, in response to the determined road condition evaluation value being not in the road condition evaluation value range corresponding to the normal sample.

9. The apparatus for predicting road conditions according to claim 8, wherein determining whether the road section is an abnormal road section according to the number of occurrences of abnormal data associated with the road section further comprises:

in response to determining that the number of continuous occurrences of abnormal data is greater than the preset threshold, determining that the road section is an abnormal road section; and in response to determining that the number of continuous occurrences of abnormal data is not greater than the preset threshold:

collecting additional driving data associated with the road section;

assigning a weight to the determined road condition evaluation value corresponding to the additional driving data according to the numbers of occurrences of abnormal data and normal data; and determining whether the road section is an abnormal road section according to the product of the determined road condition evaluation value and the assigned weight.

10. The apparatus for predicting road conditions according to claim 9, wherein assigning a weight to the determined road condition evaluation value corresponding to the additional driving data further comprises:

in response to current driving data being abnormal data, raising the weight according to a cumulative number of occurrences of abnormal data; and in response to the current driving data being normal data, lowering the weight according to a cumulative number of occurrences of normal data.

11. The apparatus for predicting road conditions according to claim 10, wherein determining whether the road section is an abnormal road section according to the product of the determined road condition evaluation value and the assigned weight further comprises:

determining that the road section is a normal road section in response to the product of the determined road condition evaluation value and the assigned weight being less than a first set threshold; and determining that the road section is an abnormal road section in response to the product of the determined road condition evaluation value and the assigned weight being greater than a second set threshold.

12. The apparatus for predicting road conditions according to claim 8, wherein determining whether the road section is an abnormal road section further comprises:

determining that the road section is an abnormal road section in response to the determined road condition evaluation value being greater than a third set threshold.

13. A non-transitory computer readable medium that stores a set of instructions that is executable by at least one processor of a computer to cause the computer to perform a method for predicting road conditions, the method comprising:

collecting driving data reflecting pavement conditions associated with a road section, the driving data recorded by one or more pavement detection instruments distributed on vehicles running on the road section;

comparing the collected driving data with a normal sample, to determine whether the driving data is abnormal data;

determining whether the road section is an abnormal road section by comparing a number of occurrences of abnormal data associated with the road section with a preset threshold;

predicting a reason for abnormality of the road section by applying a preset model to the collected driving data, in response to the road section being an abnormal road section, the reason for abnormality being associated with a type and a cause of a damage to the pavement conditions of the road section; and providing the reason for abnormality of the road to a user to perform maintenance to the road section based on the predicted type and cause of the damage to the pavement conditions of the road section.

14. The non-transitory computer readable medium according to claim 13, wherein comparing the collected driving data with a normal sample, to determine whether the driving data is abnormal data comprises:

determining a road condition evaluation value corresponding to the road section, based on the collected driving data;

comparing the determined road condition evaluation value with a road condition evaluation value range corresponding to the normal sample;

determining that the driving data is normal data, in response to the determined road condition evaluation value being in the road condition evaluation value range corresponding to the normal sample; or determining that the driving data of the road section is abnormal data, in response to the determined road condition evaluation value being not in the road condition evaluation value range corresponding to the normal sample.

15. The non-transitory computer readable medium according to claim 14, wherein determining whether the road section is an abnormal road section according to the number of occurrences of abnormal data associated with the road section comprises:

in response to the number of continuous occurrences of abnormal data being greater than a set the preset threshold, determining that the road section is an abnormal road section; and in response to the number of continuous occurrences of abnormal data being not greater than the preset threshold:

collecting additional driving data associated with the road section;

assigning a weight to the determined road condition evaluation value corresponding to the additional driving data according to the numbers of occurrences of abnormal data and normal data; and determining whether the road section is an abnormal road section according to the product of the determined road condition evaluation value and the assigned weight.

16. The non-transitory computer readable medium according to claim 15, wherein assigning a weight to the determined road condition evaluation value corresponding to the additional driving data comprises:

in response to current driving data being abnormal data, raising the weight according to a cumulative number of occurrences of abnormal data; and in response to the current driving data being normal data, lowering the weight according to a cumulative number of occurrences of normal data.

17. The non-transitory computer readable medium according to according to claim 16, wherein determining whether the road section is an abnormal road section according to the product of the determined road condition evaluation value and the assigned weight comprises:

determining that the road section is a normal road section in response to the product of the determined road condition evaluation value and the assigned weight being less than a first set threshold; and determining that the road section is an abnormal road section in response to the product of the determined road condition evaluation value and the assigned weight being greater than a second set threshold.

18. The non-transitory computer readable medium according to according to claim 14, further comprising:

determining that the road section is an abnormal road section in response to the determined road condition evaluation value being greater than a third set threshold.

* * * * *